US010826213B2

(12) United States Patent
Xu et al.

(10) Patent No.: US 10,826,213 B2
(45) Date of Patent: Nov. 3, 2020

(54) ELECTRICAL CONNECTOR HOUSING WITH BLIND CAVITIES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Guang-Lei Xu, Kunshan (CN); Wei-Guo Sun, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 35 days.

(21) Appl. No.: 16/225,360

(22) Filed: Dec. 19, 2018

(65) Prior Publication Data

US 2019/0190177 A1 Jun. 20, 2019

(30) Foreign Application Priority Data

Dec. 19, 2017 (CN) ..... 2017 2 1776664 U

(51) Int. Cl.
*H01R 13/64* (2006.01)
*H01R 12/72* (2011.01)
(Continued)

(52) U.S. Cl.
CPC ..... *H01R 12/725* (2013.01); *H01R 12/7005* (2013.01); *H01R 12/721* (2013.01);
(Continued)

(58) Field of Classification Search
CPC .. H01R 12/721; H01R 12/725; H01R 12/727; H01R 12/7005
(Continued)

(56) References Cited

U.S. PATENT DOCUMENTS 5,641,295 A * 6/1997 Koyama ..... H01R 12/7005 439/326
5,779,494 A * 7/1998 Ito ..... H01R 12/83 439/326
(Continued)

FOREIGN PATENT DOCUMENTS

CN 203135059 U 8/2013
TW M398281 2/2011

*Primary Examiner* — Hae Moon Hyeon
(74) *Attorney, Agent, or Firm* — Wei Te Chung; Ming Chieh Chang

(57) ABSTRACT

An electrical connector has an insulative elongated housing retaining a plurality of contacts therein. The housing includes an upper wall, a lower wall and a rear wall to commonly form a receiving slot. The upper wall forms a plurality of upper passageways and the lower wall forms a plurality of lower passageways to receiving the corresponding upper contacts and lower contacts therein. Each contact includes a mating section extending into the mating space and a mounting leg extending outside of the housing. The housing forms a plurality of cavities in the upper wall, the lower wall and the rear wall to relative evenly adjust the thickness of the different positions in the cross-section of the housing so as to evenly molding the housing without improper deformation/warpage when the housing is solidified after molding.

20 Claims, 9 Drawing Sheets

(51) Int. Cl.
*H01R 12/70* (2011.01)
*H01R 13/629* (2006.01)
*H01R 12/83* (2011.01)

(52) U.S. Cl.
CPC ..... *H01R 12/727* (2013.01); *H01R 13/629* (2013.01); *H01R 12/83* (2013.01)

(58) Field of Classification Search
USPC ..... 439/374, 64
See application file for complete search history.

(56) References Cited

U.S. PATENT DOCUMENTS

2013/0040498 A1* 2/2013 Cai ..... H01R 12/721
439/636
2013/0090016 A1* 4/2013 Wang ..... H01R 12/73
439/630
2019/0052000 A1* 2/2019 Sun ..... H01R 12/52

* cited by examiner

ELECTRICAL CONNECTOR HOUSING WITH BLIND CAVITIES

1. FIELD OF THE INVENTION

The invention relates to the electrical connector, and particularly to a card edge connector having the evenly molded housing with superior strength thereof.

2. DESCRIPTION OF RELATED ART

China Patent No. CN204558704 discloses card edge connector with an insulative elongated housing and a plurality of contacts retained therein. The housing includes opposite upper and lower walls with a receiving slot therebetween. Each of the upper wall and the lower wall has the corresponding upper passageways and lower passageways to retain the corresponding upper contacts and lower contacts. Because the upper wall with the corresponding upper passageways and the lower wall and the corresponding lower passageways have different configurations and dimensions from each other, different dimensions are formed in different positions in the cross-section. Accordingly, it tends to result in different flow velocities during molding the housing and the corresponding improper deformation when the housing is solidified after molding, thus jeopardizing the strength of the whole connector housing.

It is desired to have the electrical connector with an insulative evenly molded housing with the desired strength thereof.

SUMMARY OF THE INVENTION

An object of the invention is to provide an electrical connector having an insulative elongated housing retaining a plurality of contacts therein. The housing includes an upper wall, a lower wall and a rear wall to commonly form a receiving slot. The upper wall forms a plurality of upper passageways and the lower wall forms a plurality of lower passageways to receiving the corresponding upper contacts and lower contacts therein. Each contact includes a mating section extending into the mating space and a mounting leg extending outside of the housing. The housing forms a plurality of cavities in the upper wall, the lower wall and the rear wall to relative evenly adjust the thickness of the different positions in the cross-section of the housing so as to evenly molding the housing without improper deformation/warpage when the housing is solidified after molding.

Other objects, advantages and novel features of the invention will become more apparent from the following detailed description when taken in conjunction with the accompanying drawings.

DETAILED DESCRIPTION OF THE PREFERRED EMBODIMENT

Figure 1:
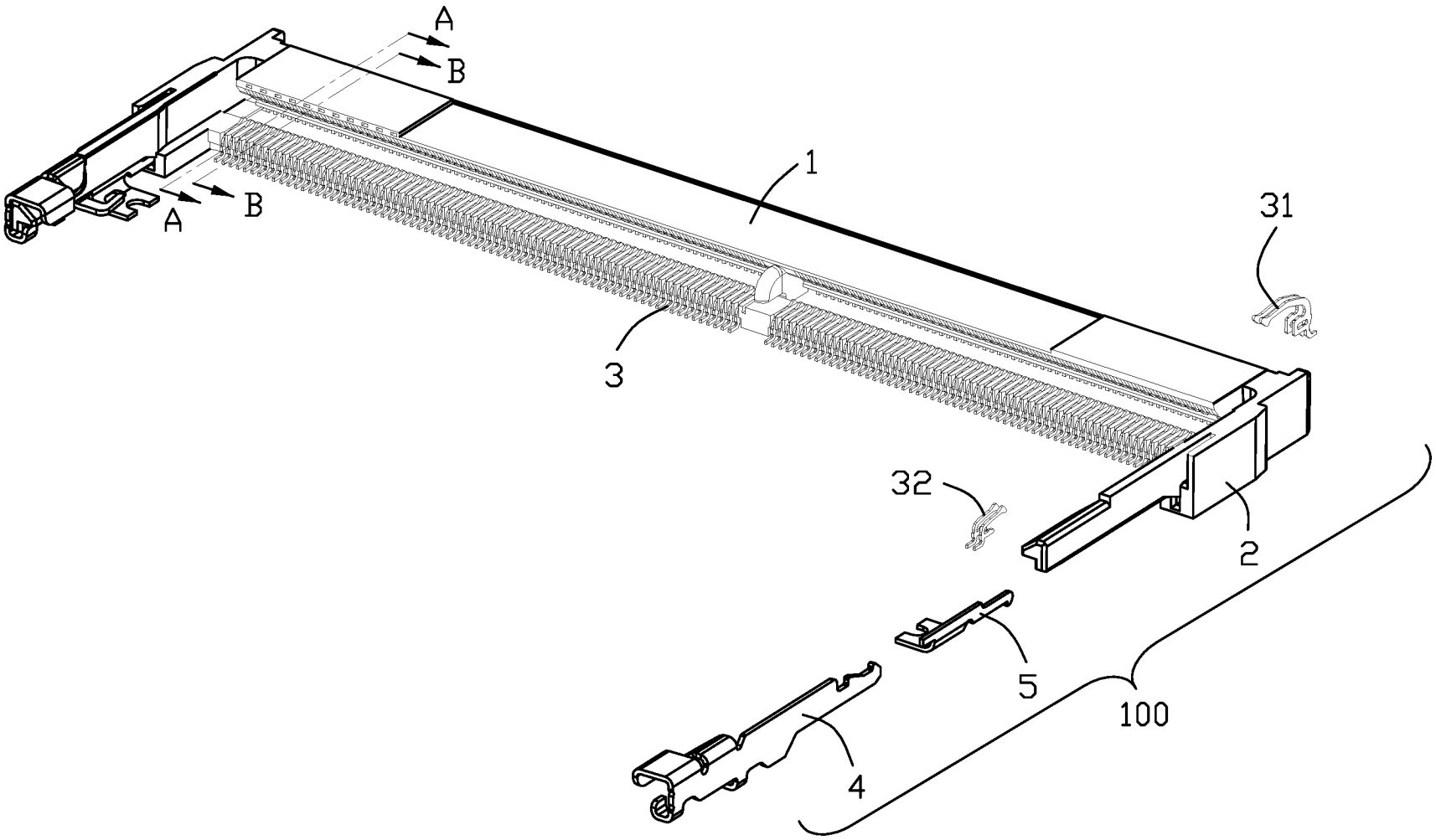
FIG. 1 is an exploded perspective view of a card edge connector of the preferred embodiment of the invention.
Figure 2:
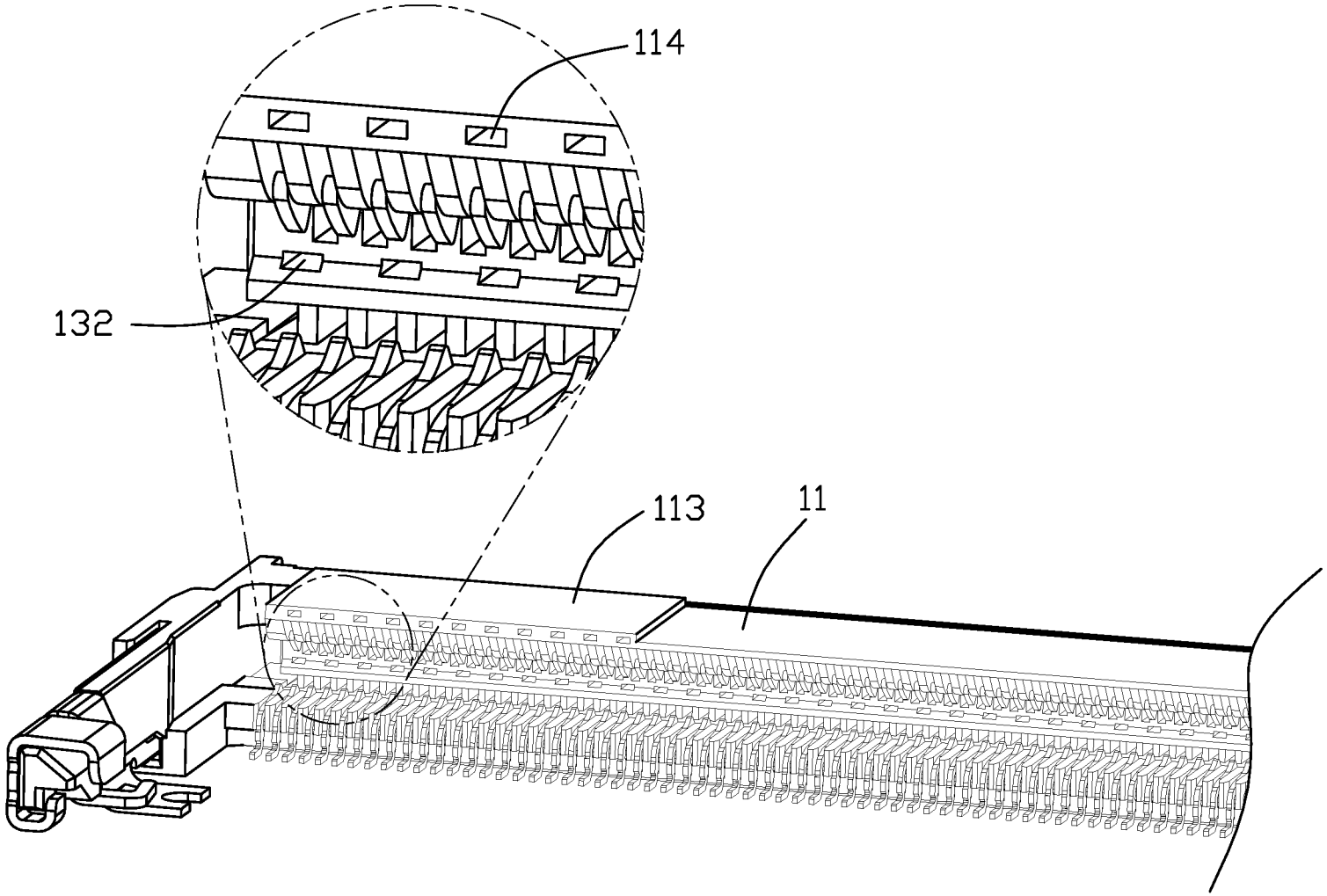
FIG. 2 is an perspective view of a portion of the card edge connector of FIG. 1.
Figure 3:
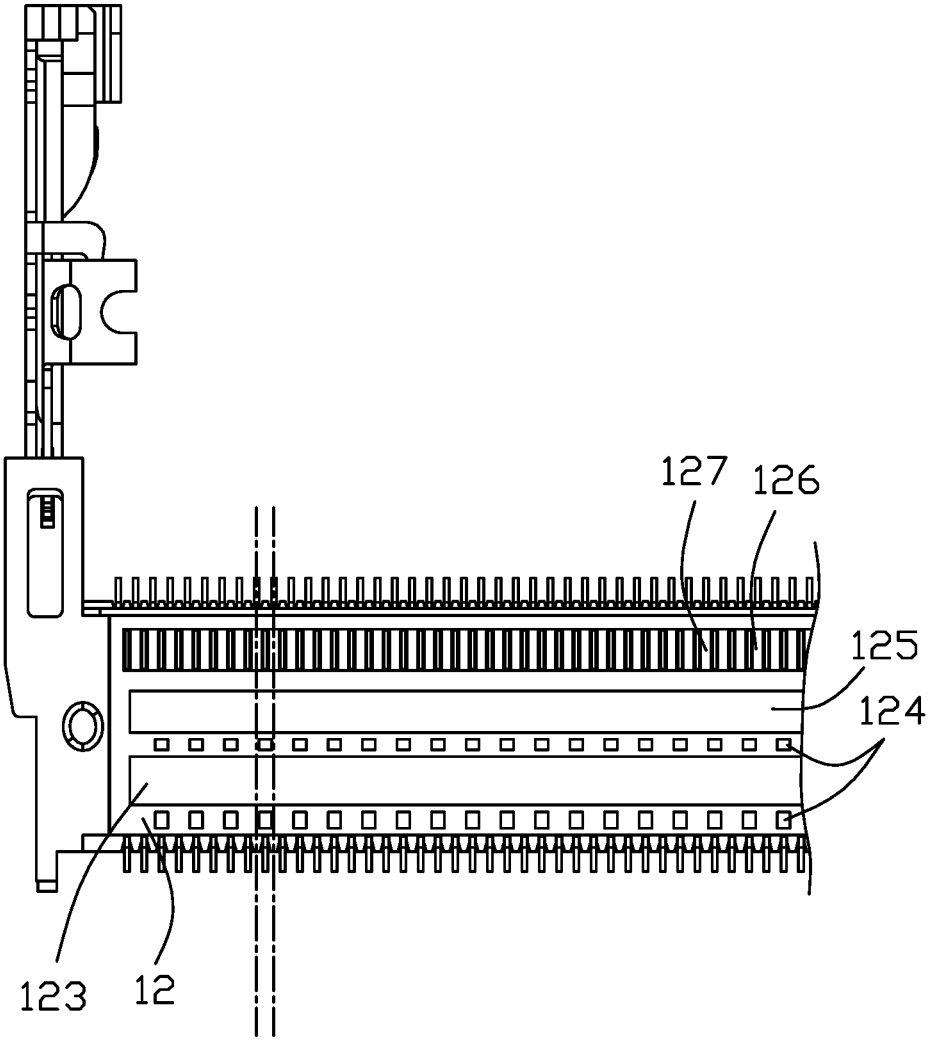
FIG. 3 is a bottom view of the portion of the card edge connector of FIG. 2.
Figure 4:
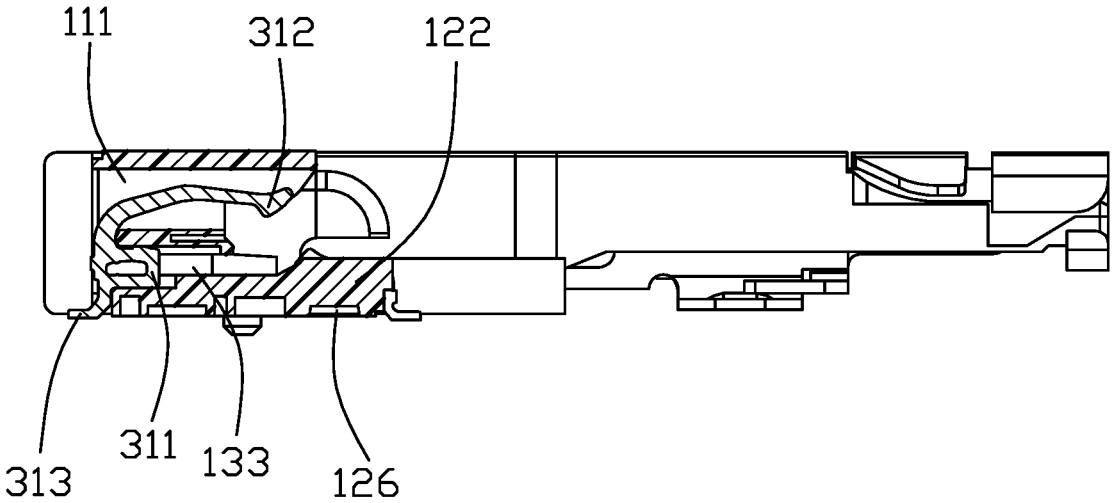
FIG. 4 is a cross-sectional view of the card edge connector of FIG. 1 along line A-A to show the upper contact and the corresponding upper passageway.
Figure 5:
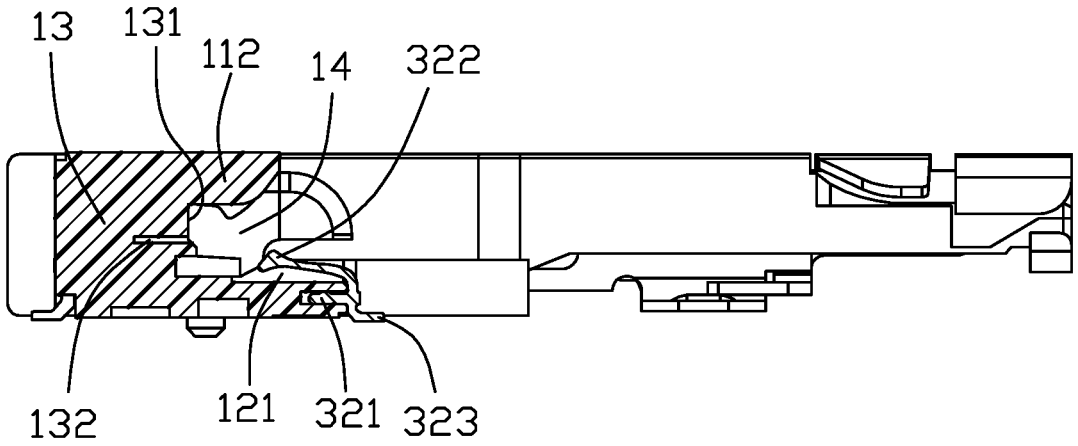
FIG. 5 is a cross-sectional view of the card edge connector of the FIG. 1 along line B-B to show the lower contact and the corresponding lower passageway.
Figure 6:
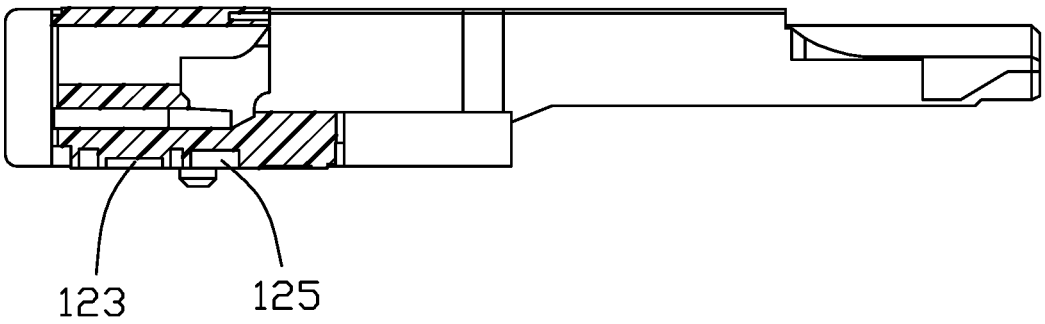
FIG. 6 is a cross-sectional view of the card edge connector of FIG. 1 to show the housing without the contacts.
Figure 7:
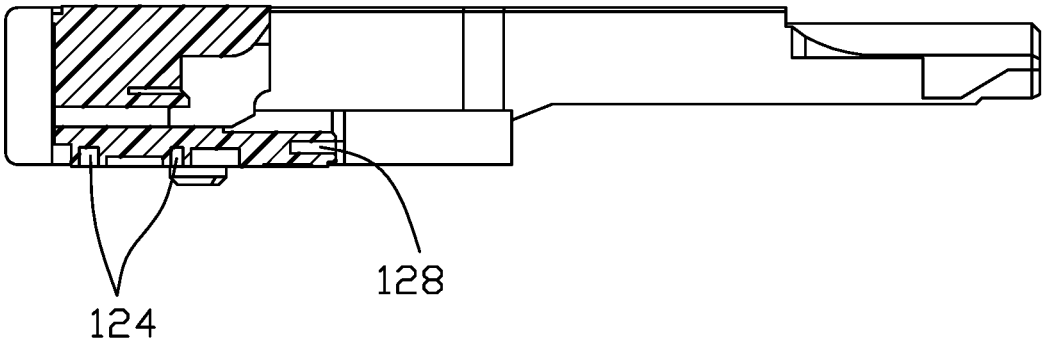
FIG. 7 is another cross-sectional view of the card edge connector of FIG. 1 to show the housing without the contacts.

Referring to FIGS. 1-7, a card edge connector 100 for receiving a card type module (not shown) therein, including an insulative elongated housing 1, a pair of end walls 2 extending forwardly from two opposite elongated ends, a plurality of contacts 3 retained in the housing 1, a pair of latches 4 secured to the corresponding end walls 2 for retaining the module, and a pair of mounted pads 5 secured to the corresponding walls 2.

The housing 1 includes an upper wall 11, a lower wall 12 and a rear wall 13 commonly forming a receiving slot 14 for receiving the module. The upper wall 11 cooperating with the rear wall 13, forms a plurality of upper passageways 111 to receive the corresponding upper contacts 31 of the contacts 3, and the lower wall 12 forms a plurality of lower passageways 121 to receiving the corresponding lower contacts 32. The upper contact includes an upper retaining section 311 retained to the housing 1, an upper mating section 312 extending forwardly from the upper retaining section 311 into the receiving slot 14, and an upper mounting leg 313 extending rearwardly from the upper retaining section 311 and exposed outside of the housing 1. Similarly, the lower contact 32 includes a lower retaining section 321, a lower mating section 322 extending from the lower retaining section 321 and a lower mounting section 323 extending from the lower retaining section 321. Notably, the upper passageways 111 and the lower passageways 121 are alternately arranged with each other along the elongated direction in a staggered manner.

Figure 8:
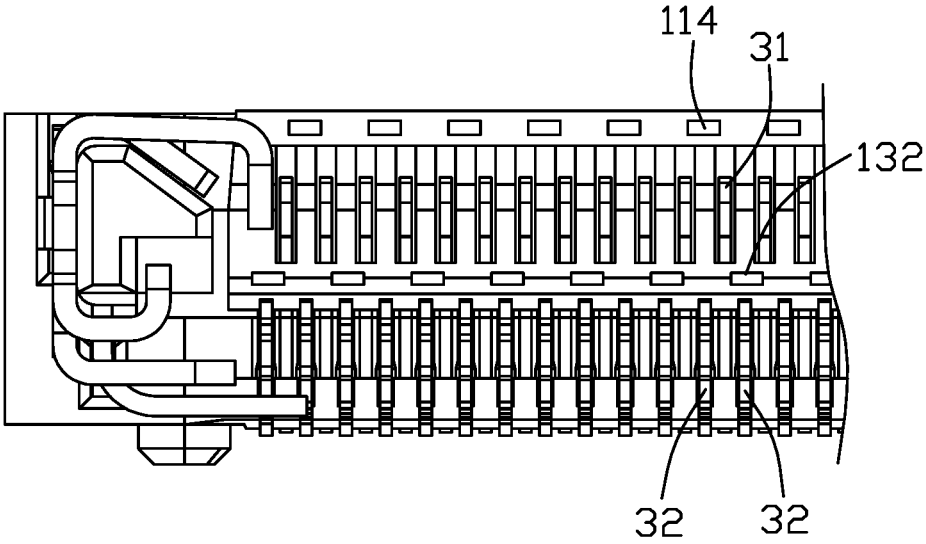
FIG. 8 is a cross-sectional view of a portion of the card edge connector of FIG. 1 to show how the first blind cavities 132 and the third blind cavities 114 are positioned with regard to the upper contacts and the lower contacts and the their corresponding upper passageways and lower passageways.
Figure 9:
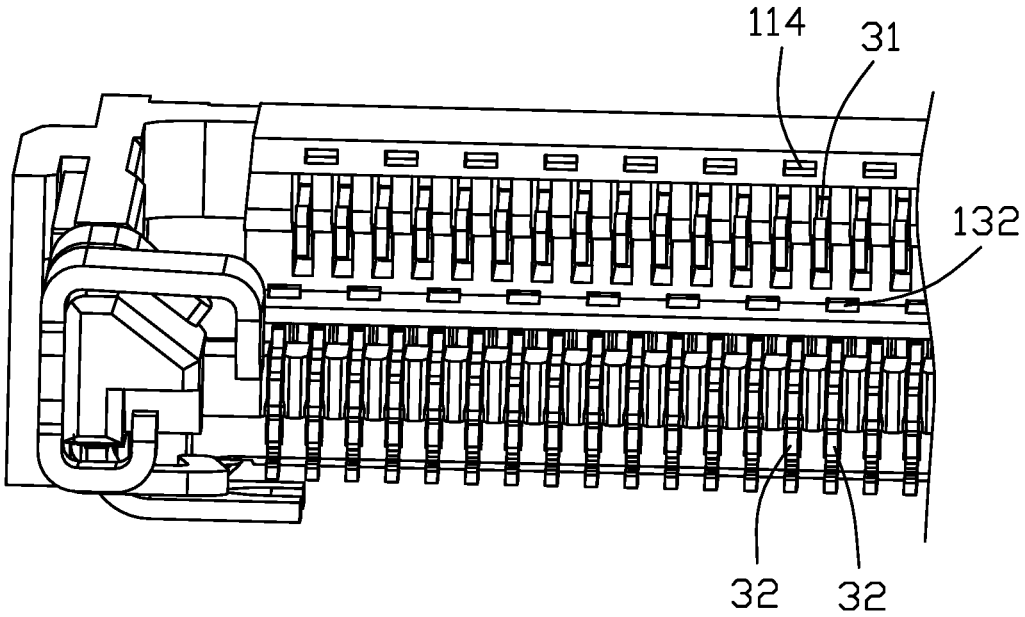
FIG. 9 is a perspective view of the portion of the card edge connector of FIG. 8.

The upper wall 11 includes a plurality of upper partitions 112 alternate arranged with the corresponding upper passageways 111 along the longitudinal direction, and the lower wall 12 includes a plurality of lower partitions 122 alternately arranged with the corresponding lower passageways 112 along the longitudinal direction as well. The rear wall 13 forms a front wall 131 forwardly confronting the receiving slot 14, and a plurality of first/inner/middle blind cavities 132 formed in the front wall 131 to forwardly communicate with the receiving slot 14. The first blind cavities 132 are arranged corresponding to every two lower passageways 121, i.e., the pitch of the first blind cavities 132 being twice that of the lower passageways 121, wherein in a front view each first blind cavity 132 is aligned with one of the corresponding two lower passageways 121 in the vertical direction. Notably, the width of the first blind cavity 132, along the longitudinal direction, is slightly larger than that of the lower passageways 121. In a bottom face of the rear wall 13 and that of the lower wall 12, there are two rows of second/bottom/lower blind cavities 124 by two side of a first blind slot 123 in the front-to-back direction, and a second blind slot 125 and a third blind slot 126 located in front of the two rows of second blind cavities 124. Each second blind cavity 124 is aligned with the corresponding upper passageway 111 in the vertical direction. Similar to the first blind cavities 132, the pitch of the second blind cavities 124 is twice that of the upper passageways 111. A plurality of ribs 127 are formed in the third blind slot 126 wherein the ribs 127 are aligned with the lower passageways 121, respectively. In this embodiment, two rows of second blind cavities 124 are respectively aligned with each other in the front-to-back direction while the front row of the second blind cavities 124 are smaller than the rear row of second blind cavities 124 in the front-to-back direction. The depth of the second blind slot 125 in the vertical direction is larger than that of the first blind slot 123. The upper wall 11 forms a pair of extensions 113 on the top. Each extension 113 forms a plurality of third/upper blind cavities 114. Similar to the first blind cavities 132, the third blind cavities 114 are arranged corresponding to every two lower passageways 121 wherein the pitch of the third blind cavities 114 is twice of that of the lower passageway 121, and in a front view each third blind cavity 132 is aligned with the other of the corresponding two lower passageways 121 in the vertical direction. Accordingly, the first blind cavities 132 and the third blind cavities 114 are staggered with each other along the longitudinal direction as shown in FIGS. 8 and 9. Similar to the first blind cavity 132, the width of the third blind cavity 114 is slightly larger than that of the lower passageway 121. Understandably, because both the first blind cavities 132 and the third blind cavities 114 are respectively aligned with the corresponding lower passageways 121 in the vertical direction, both of them are respectively offset from the corresponding upper passageways 111. Notably, the rear wall 13 and the lower wall 12 forms the retaining slots 133, 128 to respectively receive the corresponding upper retaining sections 311 of the upper contacts 31 and the lower retaining sections 321 of the lower contacts, respectively.

In brief, because of the first blind cavities 132, the second blind cavities 124, the third blind cavities 114, the first blind slot 123, the second blind slot 125 and the third blind slot 126, the velocity of the flow of the liquid material of the housing during molding along the longitudinal direction may be reduced to allow the upper partitions 112 and the lower partitions 122 to be formed sufficiently. Understandably, such blind cavities should be arranged without jeopardizing the required strength of the housing so it is the reason why the pitch of the blind cavities should be larger than or times of that of the passageways wherein the first blind cavities 132 and the third blind cavities 114 are required to be further offset from each other in a staggered manner.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A card edge connector comprising:

an insulative elongated housing extending along a longitudinal direction with an upper wall and a lower wall opposite to each other in a vertical direction perpendicular to the longitudinal direction, and further a rear wall to commonly define a receiving slot extending along said longitudinal direction;

a plurality of upper passageways formed in the upper wall and rear wall and spaced from one another along the longitudinal direction;

a plurality of lower passageways formed in the lower wall, spaced from one another along the longitudinal direction, and being alternately arranged with the corresponding upper passageways with a same pitch in a staggered manner along the longitudinal direction;

a plurality of upper contacts disposed in the upper passageways, respectively;

a plurality of lower contacts disposed in the lower passageways, respectively;

a row of inner/middle blind cavities being formed in a front surface of the rear wall between the upper wall and the lower wall and spaced from one another along the longitudinal direction; wherein said inner/middle blind cavities forwardly confront the receiving slot.

2. The card edge connector as claimed in claim 1, wherein a pitch of said row of inner/middle blind cavities is twice of that of the lower passageways.

3. The card edge connector as claimed in claim 2, wherein in a front view, said row of inner/middle blind cavities are aligned with either the upper passageways or the lower passageways in a said vertical direction.

4. The card edge connector as claimed in claim 3, wherein in the front view, said row of inner/middle blind cavities are aligned with the lower passageways, respectively, in said vertical direction.

5. The card edge connector as claimed in claim 2, further including a row of bottom blind cavities in a bottom surface of the rear wall and that of the lower wall, wherein said row of bottom blind cavities are spaced from one another along the longitudinal direction.

6. The card edge connector as claimed in claim 5, wherein a pitch of said row of bottom blind cavities is twice that of the upper passageways.

7. The card edge connector as claimed in claim 6, wherein said row of bottom blind cavities are aligned with either the upper passageways or the lower passageways, respectively, in the vertical direction.

8. The card edge connector as claimed in claim 7, wherein said row of bottom blind cavities are aligned with the upper passageways, respectively.

9. The card edge connector as claimed in claim 5, further including a bottom blind slot extending along the longitudinal direction in the bottom surfaces beside said row of bottom blind cavities in a front-to-back direction perpendicular to both the longitudinal direction and the vertical direction.

10. The card edge connector as claimed in claim 9, further including another row of bottom blind cavities in the bottom surfaces to cooperate with said row of bottom blind cavities with said bottom blind slot therebetween in the front-to-back direction.

11. The card edge connector as claimed in claim 5, further including a row of upper blind cavities formed in the upper wall, forwardly communicating with an exterior and spaced from one another along the longitudinal direction.

12. The card edge connector as claimed in claim 11, wherein said row of upper blind cavities alternately arranged with said row of inner/middle blind cavities in a staggered manner with a same pitch along the longitudinal direction.

13. A card edge connector comprising:

an insulative elongated housing extending along a longitudinal direction with an upper wall and a lower wall opposite to each other in a vertical direction perpendicular to the longitudinal direction, and further a rear wall to commonly define a receiving slot extending along said longitudinal direction;

a plurality of upper passageways formed in the upper wall and rear wall and spaced from one another along the longitudinal direction;

a plurality of lower passageways formed in the lower wall, spaced from one another along the longitudinal direction, and being alternately arranged with the corresponding upper passageways with a same pitch in a staggered manner along the longitudinal direction;

a plurality of upper contacts disposed in the upper passageways, respectively;

a plurality of lower contacts disposed in the lower passageways, respectively;

and a plurality of bottom blind cavities formed in a bottom surface of the rear wall and that of the lower wall and spaced from one another along the longitudinal direction.

14. The card edge connector as claimed in claim 13, wherein a pitch of said row of bottom blind cavities is twice that of the lower passageways.

15. The card edge connector as claimed in claim 14, wherein said bottom blind cavities are aligned with the corresponding upper passageways, respectively, in the vertical direction.

16. The card edge connector as claimed in claim 15, further including a bottom blind slot in said bottom surfaces beside said row of bottom blind cavities in a front-to-back direction perpendicular to both the vertical direction and the longitudinal direction.

17. The card edge connector as claimed in claim 16, further including another row of bottom blind cavities in said bottom surfaces to cooperate with said row of bottom blind cavities with the bottom blind slot therebetween in the front-to-back direction.

18. The card edge connector as claimed in claim 17, wherein said row of bottom blind cavities and said another row of bottom blind cavities are aligned with each other in the front-to-back direction.

19. The card edge connector as claimed in claim 15, further including a row of inner/middle blind cavities formed in a front face of the rear wall confronting forwardly the receiving slot, wherein in a front view, said row of inner/middle blind cavities are aligned with the corresponding lower passageways, respectively, in the vertical direction.

20. The card edge connector as claimed in claim 15, further including a row of upper blind cavities formed in the upper wall and forwardly communicating with an exterior, wherein in a front view, said row of upper blind cavities are aligned with the corresponding lower passageways, respectively, in the vertical direction.

* * * * *